US010570934B2

(12) United States Patent
Kudo et al.

(10) Patent No.: US 10,570,934 B2
(45) Date of Patent: Feb. 25, 2020

(54) FLUIDIC CYLINDER

(71) Applicant: SMC CORPORATION, Chiyoda-ku (JP)

(72) Inventors: Masayuki Kudo, Tsukubamirai (JP); Yasunaga Suzuki, Kasukabe (JP); Shinichiro Nemoto, Tsukubamirai (JP); Jun Yamada, Ushiku (JP); Eiko Miyasato, Tsukubamirai (JP); Yuu Mizutani, Tsukubamirai (JP); Ken Tamura, Tsukubamirai (JP); Masahiko Kawakami, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 123 days.

(21) Appl. No.: 15/516,323

(22) PCT Filed: Sep. 10, 2015

(86) PCT No.: PCT/JP2015/075680
§ 371 (c)(1),
(2) Date: Mar. 31, 2017

(87) PCT Pub. No.: WO2016/052126
PCT Pub. Date: Apr. 7, 2016

(65) Prior Publication Data

US 2017/0298931 A1 Oct. 19, 2017

(30) Foreign Application Priority Data

Oct. 2, 2014 (JP) ..... 2014-203740

(51) Int. Cl.
*F15B 15/14* (2006.01)
*F15B 15/28* (2006.01)
*F15B 15/22* (2006.01)

(52) U.S. Cl.
CPC ..... *F15B 15/1419* (2013.01); *F15B 15/1452* (2013.01); *F15B 15/2861* (2013.01); *F15B 15/1414* (2013.01); *F15B 15/226* (2013.01)

(58) Field of Classification Search
CPC ..... F15B 15/1414; F15B 15/1419; F15B 15/2861
See application file for complete search history.

(56) References Cited

U.S. PATENT DOCUMENTS 3,180,236 A * 4/1965 Beckett ..... F15B 15/1414 277/438
3,815,480 A 6/1974 Spyra
(Continued)

FOREIGN PATENT DOCUMENTS

DE 20 2005 005 508 U1 7/2005
JP 2-103502 U 8/1990
(Continued)

OTHER PUBLICATIONS

JP-2012002325-A machine translation from espacenet. 2012.*
(Continued)

*Primary Examiner* — Thomas E Lazo
*Assistant Examiner* — Michael Quandt
(74) *Attorney, Agent, or Firm* — Oblon, McClelland, Maier & Neustadt, L.L.P.

(57) ABSTRACT

The present invention relates to a fluidic cylinder. This fluidic cylinder is configured in such a manner that a piston unit is received in an axially displaceable manner within a cylinder tube formed in a rectangular cross-sectional shape. The piston unit has: a base body having the front end of a piston rod staked thereto; a wear ring having the base body received therein and having a magnet incorporated therein; and piston packing adjacent to the wear ring. The piston unit is integrally held at one end of the piston rod. The wear ring
(Continued)

and the piston packing are formed in a rectangular cross-sectional shape corresponding to the rectangular cross-sectional shape of the cylinder tube and are provided rotatable relative to the piston rod.

12 Claims, 18 Drawing Sheets

(56) References Cited

U.S. PATENT DOCUMENTS

| | | | | |
|---|---|---|---|---|
| 5,400,696 | A | 3/1995 | Weber | |
| 5,609,343 | A * | 3/1997 | Asou | F16J 15/32 137/625.66 |
| 6,637,316 | B2 * | 10/2003 | Engelke | F15B 15/1414 92/165 PR |
| 7,557,568 | B2 * | 7/2009 | Terasaki | F15B 15/2861 324/207.2 |
| 2010/0212491 | A1 * | 8/2010 | Nishi | F15B 15/226 92/85 R |
| 2010/0319530 | A1 | 12/2010 | Ryu | |
| 2011/0126703 | A1 | 6/2011 | Terasaki et al. | |
| 2015/0285277 | A1 | 10/2015 | Takakuwa | |

FOREIGN PATENT DOCUMENTS

| | | | | |
|---|---|---|---|---|
| JP | 5-52305 | U | | 7/1993 |
| JP | 6-235405 | A | | 8/1994 |
| JP | 6-47126 | Y2 | | 11/1994 |
| JP | 9-303326 | A | | 11/1997 |
| JP | 2001-234903 | A | | 8/2001 |
| JP | 2010-266054 | A | | 11/2010 |
| JP | 2011-508127 | A | | 3/2011 |
| JP | 2011-112205 | A | | 6/2011 |
| JP | 2012002325 | A | * | 1/2012 |
| WO | 2014/097441 | A1 | | 6/2014 |

OTHER PUBLICATIONS

International Search Report dated Dec. 15, 2015 in PCT/JP2015/075680 Filed Sep. 10, 2015.

Office Action dated Aug. 28, 2018 in Korean Patent Application No. 10-2017-7011366, 10 pages (with English language translation).

German Office Action dated Apr. 11, 2019 issued in German Patent Application No. 112015004510.4, 5 pages.

* cited by examiner

FLUIDIC CYLINDER

TECHNICAL FIELD

The present invention relates to a fluid pressure cylinder (fluidic cylinder) for displacing a piston in an axial direction under operation of supplying pressurized fluid.

BACKGROUND ART

Conventionally, as means for transporting a workpiece, etc., a fluid pressure cylinder having a piston displaced under operation of supplying pressurized fluid has been used.

For example, Japanese Laid-Open Patent Publication No. 06-235405 discloses a fluid pressure cylinder of this type. The fluid pressure cylinder includes a cylindrical cylinder tube, a cylinder cover provided at one end of the cylinder tube, and a piston provided in a displaceable manner inside the cylinder tube. Further, each of the piston and the cylinder tube has a non-circular shape in cross section perpendicular to the axial line. In the structure, in comparison with the case of using a piston having a circular shape in cross section, the pressure receiving surface area is increased, and the outputted thrust force is increased.

Further, Japanese Laid-Open Patent Publication No. 2011-508127 (PCT) discloses a cylinder apparatus including a piston having a square shape in cross section. The cylinder apparatus includes a cylinder housing also having a square shape in cross section corresponding to the cross sectional shape of the piston. Sealing members are provided through grooves at outer marginal portions of the piston. The sealing members contact inner wall surfaces of the cylinder housing to perform sealing operation.

SUMMARY OF INVENTION

In the fluid pressure cylinders having a non-circular piston as disclosed in Japanese Laid-Open Patent Publication No. 06-235405 and Japanese Laid-Open Patent Publication No. 2011-508127 (PCT), there is a demand to achieve further reduction of the longitudinal dimension in the axial direction.

A general object of the present invention is to provide a fluid pressure cylinder in which it is possible to increase a thrust force, and achieve reduction in a longitudinal dimension.

In order to achieve the above object, the present invention provides a fluid pressure cylinder including a cylindrical cylinder tube including an internal cylinder chamber, a pair of cover members attached to both ends of the cylinder tube, a piston provided in a displaceable manner along the cylinder chamber, and a piston rod coupled to the piston.

Each of the piston and the cylinder tube is formed to have a rectangular shape in cross section, the piston includes a wear ring configured to slide on an inner wall surface of the cylinder tube, and a magnet is provided in the wear ring.

In the present invention, each of the piston and the cylinder tube of the fluid pressure cylinder has a rectangular shape in cross section. The piston includes the wear ring which slides on the inner wall surface of the cylinder tube, and the magnet is provided in the wear ring. In the structure, in comparison with a fluid pressure cylinder where a wear ring and a magnet are arranged in alignment in an axial direction on an outer circumferential surface of a piston, it is possible to reduce the size in the axial direction in which the piston is displaced. Consequently, by providing the piston having the rectangular shape in cross section to achieve a large pressure receiving surface area, it becomes possible to obtain a larger thrust force, and reduce a longitudinal size of the fluid pressure cylinder including the piston.

The above object, features, and advantages will be readily understood from the following embodiments which will be described with reference to the accompanying drawings.

DESCRIPTION OF EMBODIMENTS

Figure 1:
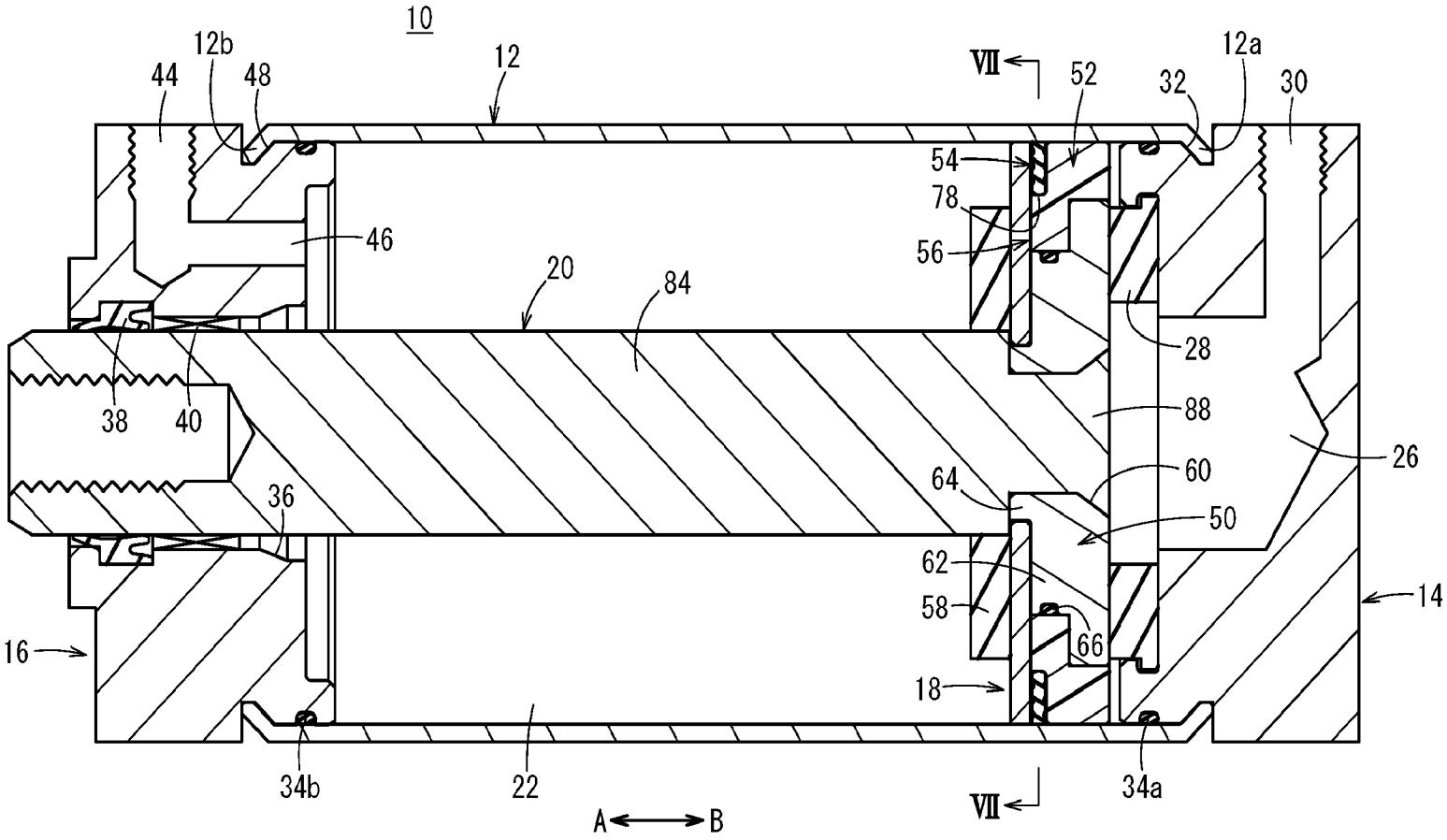
FIG. 1 is an overall cross sectional view of a fluid pressure cylinder according to a first embodiment of the present invention.

In FIG. 1, a reference numeral 10 denotes a fluid pressure cylinder according to a first embodiment of the present invention. As shown in FIG. 1, the fluid pressure cylinder includes a cylinder tube 12 having a rectangular shape in cross section, a head cover (cover member) 14 attached to one end of the cylinder tube 12, a rod cover (cover member) 16 attached to the other end of the cylinder tube 12, a piston unit (piston) 18 provided in a displaceable manner inside the cylinder tube 12, and a piston rod 20 coupled to the piston unit 18.

The cylinder tube 12 is a cylindrical body, e.g., made of metal material, and extends with a constant cross sectional area in an axial direction (indicated by arrows A and B). A cylinder chamber 22 is formed in the cylinder tube 12. The piston unit 18 is placed in the cylinder chamber 22.

Figure 2:
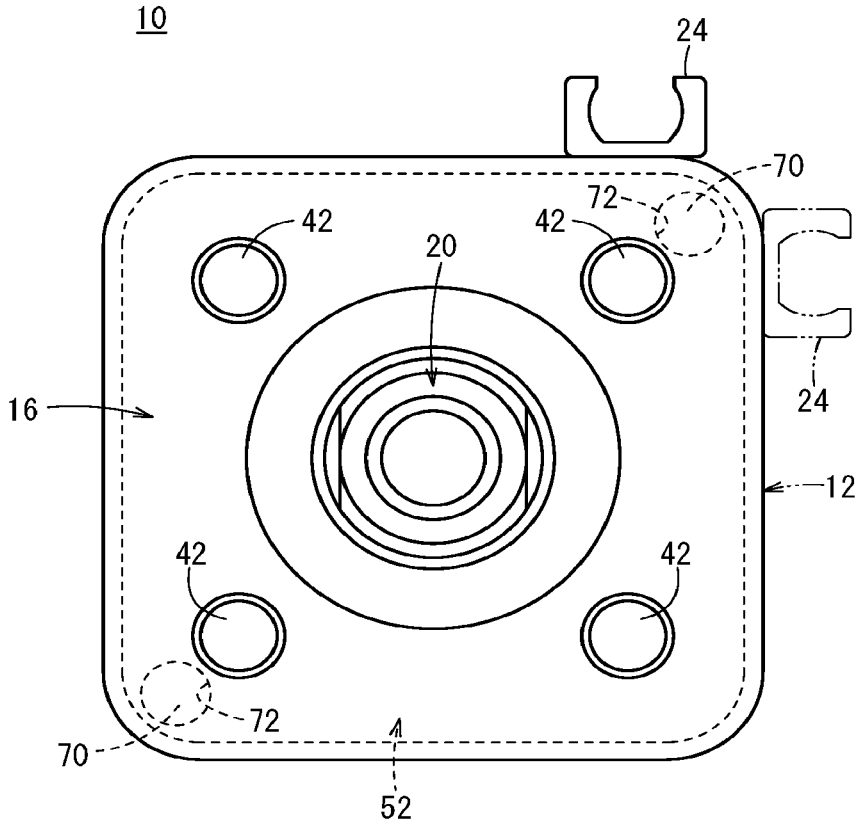
FIG. 2 is a front view of the fluid pressure cylinder, as viewed from a rod cover of the fluid pressure cylinder in FIG. 1.

Further, as shown in FIG. 2, a sensor attachment rail 24 is provided outside the cylinder tube 12. The sensor attachment rail 24 is used for attaching a detection sensor (not shown). This sensor attachment rail 24 has a substantially U-shape opened in a direction away from the cylinder tube 12. The sensor attachment rail 24 has a predetermined length in the axial direction (indicated by the arrows A and B) of the cylinder tube 12. The sensor attachment rail 24 is attached to a position adjacent to a corner of the cylinder tube 12 having a rectangular shape in cross section. Further, a detection sensor (not shown) is fixedly attached to the sensor attachment rail 24 for detecting a position of the piston unit 18 in the axial direction.

As shown in FIG. 1, for example, the head cover 14 is made of metal material, and has a substantially rectangular shape in cross section. A connection hole 26 having a predetermined depth is formed at the center of the head cover 14. The connection hole 26 faces the cylinder tube 12 (in the direction indicated by the arrow A). A first damper 28 is attached to the head cover 14 around the outer circumferential side of the connection hole 26 through a groove formed at an end of the head cover 14. For example, the first damper 28 is made of elastic material, and has a ring shape. An end of the first damper 28 protrudes slightly from the end of the head cover 14 toward the cylinder tube 12 (in the direction indicated by the arrow A).

A first fluid port 30 is formed on a side surface of the head cover 14. Pressurized fluid is supplied/discharged through the first fluid port 30. The first fluid port 30 is connected to the connection hole 26. Thus, after pressurized fluid is supplied from a pressurized fluid supply source (not shown) to the first fluid port 30, the pressurized fluid flows into the connection hole 26.

Further, an annular first engagement groove 32 depressed inward is provided along an outer circumferential surface, on a side surface of the head cover 14, at an end closer to the cylinder tube 12 (in the direction indicated by the arrow A) from the first fluid port 30. Then, one end of the cylinder tube 12 is pressed inward (toward the head cover 14), and deformed to be engaged with the first engagement groove 32 as a caulking or swage portion 12*a*. Thus, one end of the cylinder tube 12 and the head cover 14 are coupled together through the swage portion 12*a*. Further, a seal member 34*a* provided on a side surface of the head cover 14 contacts an inner surface of the cylinder tube 12. Thus, leakage of the pressurized fluid through the space between the head cover 14 and the cylinder tube 12 is prevented.

Figure 3:
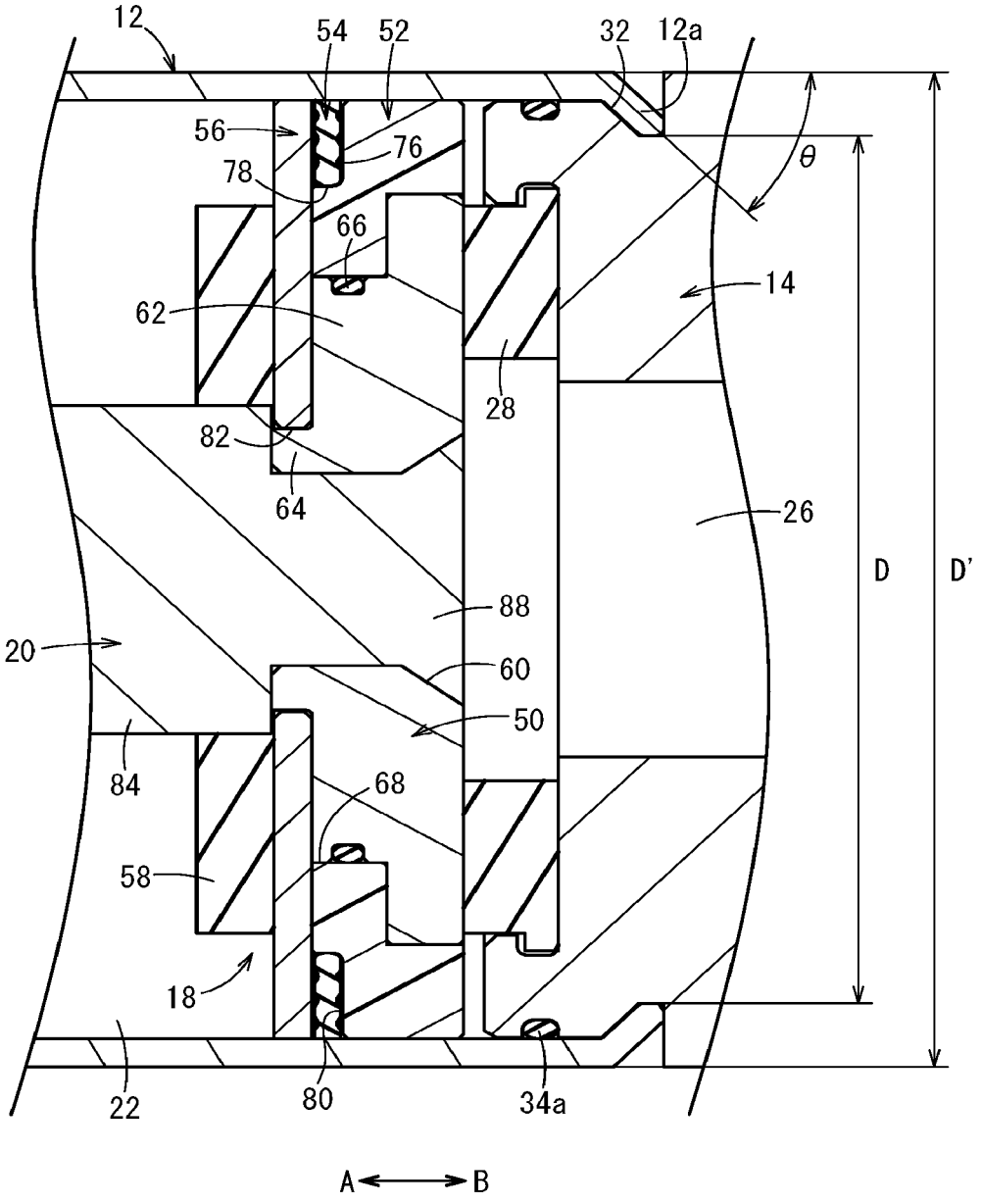
FIG. 3 is an enlarged cross sectional view showing an area around a piston unit of the fluid pressure cylinder in FIG. 1.

In this regard, for example, as shown in FIG. 3, the swage portion 12*a* of the cylinder tube 12 is bent inward from the axial direction (indicated by the arrows A and B) of the cylinder tube 12 at an inclination angle θ in a range of 45° to 90°. The opening dimension D of the swage portion 12*a* which is perpendicular to the axial line of the cylinder tube 12 is determined to become smaller than the outer dimension D' of the cylinder tube 12 by 3% to 10%. Stated otherwise, the opening dimension is determined in a manner that the depth of the swage portion 12*a* toward the cylinder tube 12 reaches a position where the opening dimension D becomes smaller than the outer dimension D' of the cylinder tube 12 by 3% to 10%.

Figure 4A:
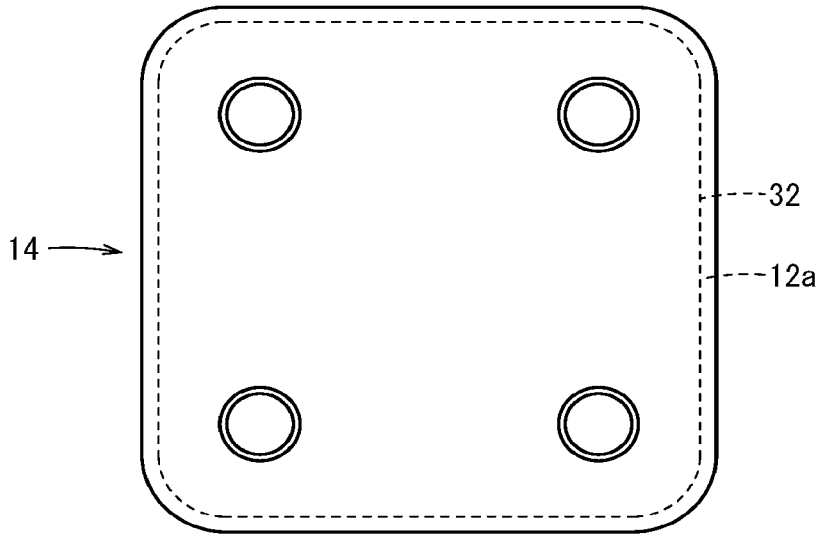
FIG. 4A is a front view of the fluid pressure cylinder as viewed from the head cover.

Further, the swage portion 12*a* is formed over the entire outer circumference of the head cover 14 by rolling swaging (see FIG. 4A).

Figure 4B:
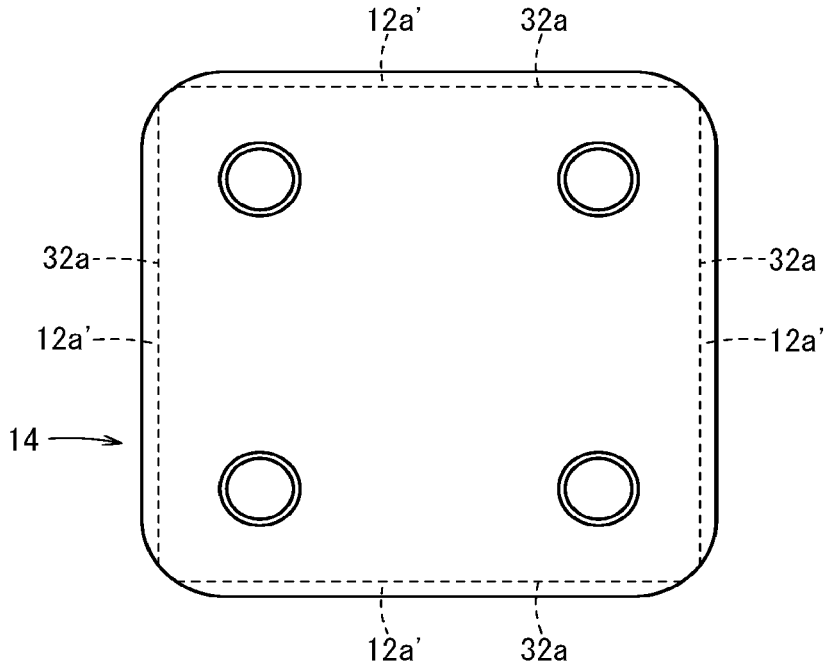
FIG. 4B is a front view of the fluid pressure cylinder, showing a modified embodiment in which a method of swaging a cylinder tube against the head cover is changed.

It is not essential that the swage portion 12*a* is formed in an annular shape over the entire circumference of the cylinder tube 12. For example, as in the case of a swage portion 12*a*' shown in FIG. 4B, the swage portion 12*a* may have a substantially straight line shape in cross section, and swaged against a first engagement groove 32*a* of the head cover 14 in a manner that the swage portion 12*a* is engaged with only four sides of the cylinder tube 12 having a rectangular shape in cross section.

As in the case of the head cover 14, the rod cover 16 is made of metal material, and has a substantially rectangular shape in cross section. A rod hole 36 passes through the center of the rod cover 16 in an axial direction (indicated by the arrows A and B). A rod packing 38 and a bush 40 are provided in an inner circumferential surface of the rod hole 36 through respective annular grooves. When the piston rod 20 is inserted into the rod hole 36, the rod packing 38 slides on the outer circumferential surface of the piston rod 20. Thus, leakage of the pressurized fluid through the space between the rod cover 16 and the piston rod 20 is prevented. The bush 40 slides on the outer circumferential surface in a manner that the piston rod 20 is guided in the axial direction (indicated by the arrows A and B).

Further, as shown in FIG. 2, attachment holes 42 each having a predetermined depth in the axial direction are formed near four corners of an end surface of the rod cover 16. For example, at the time of fixing the fluid pressure cylinder to another device (not shown), etc., fixing bolts inserted into the other device are screwed into the attachment holes 42 of the rod cover 16 to fix the fluid pressure cylinder.

As shown in FIG. 1, a second fluid port 44 is provided on a side surface of the rod cover 16, for supplying/discharging the pressurized fluid through the second fluid port 44. The second fluid port 44 is connected to the cylinder chamber 22 through a connection channel 46 extending in the axial direction (indicated by the arrow B) of the rod cover 16. The pressurized fluid supplied from the second fluid port 44 flows from the connection channel 46 into the cylinder chamber 22.

Further, an annular second engagement groove 48 depressed inward is provided along an outer circumferential surface, i.e., on a side surface of the rod cover 16, at an end closer to the cylinder tube 12 (in the direction indicated by the arrow B) from the second fluid port 44. Then, the other end of the cylinder tube 12 is pressed inward (toward the rod cover 16), and deformed to be engaged with the second engagement groove 48 as a caulking or swage portion 12*b*. Thus, the other end of the cylinder tube 12 and the rod cover 16 are coupled together through the swage portion 12*b*. Further, a seal member 34*b* provided on the side surface of the rod cover 16 contacts an inner surface of the cylinder tube 12. Thus, leakage of the pressurized fluid through the space between the rod cover 16 and the cylinder tube 12 is prevented.

In this regard, as in the case of the swage portion 12*a* at the one end, the swage portion 12*b* of the cylinder tube 12 is bent inward from the axial direction (indicated by the arrows A and B) of the cylinder tube 12 at an inclination angle θ in a range of 45° to 90°. The opening dimension D of the swage portion 12*b* is determined to become smaller than the outer dimension D' of the cylinder tube 12 by 3% to 10% (0.9 to 0.97 D'). Further, the swage portion 12*b* is formed over the entire outer circumference of the rod cover 16 by rolling swaging.

That is, the swage portion 12*a* at the one end of the cylinder tube 12 and the swage portion 12*b* at the other end of the cylinder tube 12 have substantially the same shape, and are engaged with the head cover 14 and the rod cover 16, respectively.

It should be noted that the cylinder tube 12 may be coupled to the head cover 14 and the rod cover 16 by, e.g., welding, adhesion, etc. instead of swaging.

As shown in FIGS. 1, 3, 5, and 6, the piston unit 18 is provided at one end of the piston rod 20, and includes a base body (coupling body) 50, a wear ring 52 provided around the base body 50, a piston packing 54 adjacent to the wear ring 52, a plate body 56 adjacent to the piston packing 54, and a second damper 58 provided adjacent to the plate body 56, at the position closest to the other end of the piston rod 20 (in the direction indicated by the arrow A).

For example, the base body 50 is made of metal material, and has a circular disk shape. A swaging hole 60 is formed at the center of the base body 50. One end of the piston rod 20 is inserted into the swaging hole 60 for caulking or swaging. The diameter of the swaging hole 60 is gradually increased toward one end of the piston unit 18 (in the direction indicated by the arrow B). The diameter at one end of the piston rod 20 is increased in correspondence with the shape of the swaging hole 60 to limit the relative displacement in the axial direction (indicated by the arrows A and B). In this state, the base body 50 and the piston rod 20 are coupled together integrally.

Further, as shown in FIG. 3, the base body 50 has one end having a planar shape perpendicular to the axial line. A first projection 62 protruding toward the adjacent wear ring 52 and a second projection 64 protruding beyond the first projection 62 (in the direction indicated by the arrow A) are formed at the other end of the base body 50. Each of the first projection 62 and the second projection 64 has a circular shape in cross section. The diameter of the second projection 64 is smaller than the diameter of the first projection 62. Further, a ring shaped gasket (seal member) 66 is attached to the outer circumferential surface of the first projection 62 through an annular groove.

For example, the wear ring 52 is made of resin material, and has a substantially rectangular shape in cross section. The outer shape of the wear ring 52 is substantially the same as the cross sectional shape of the cylinder chamber 22. An attachment hole 68 is formed at the center of the wear ring 52 for attaching the base body 50 to the attachment hole 68. A pair of magnet holes 72 are formed in one end surface of the wear ring 52, as one end of the piston unit 18 (in the direction indicated by the arrow B) for attaching magnets 70 to the magnet holes 72. The attachment hole 68 passes through the wear ring 52 in the thickness direction (indicated by the arrows A and B).

The diameter of the attachment hole 68 is formed stepwise to have different diameters in the axial direction (indicated by arrows A and B), and the first projection 62 and the second projection 64 of the base body 50 are engaged with the attachment hole 68. Thus, the base body 50 is placed and held at the center of the attachment hole 68. In this regard, one end surface of the base body 50 does not protrude from one end surface of the wear ring 52. That is, these surfaces form the same plane surface (see FIG. 3).

Figure 5:
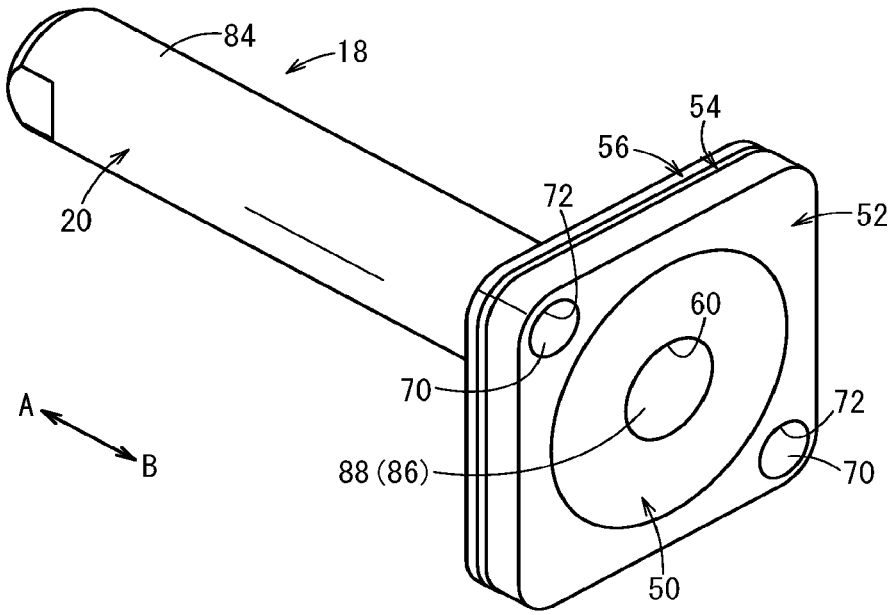
FIG. 5 is a perspective view showing an outer appearance of a piston rod and a piston unit of the fluid pressure cylinder in FIG. 1.

For example, the magnet holes 72 are formed at pair of corners positioned diagonally with respect to the attachment hole 68 at the center. Each of the magnet holes 72 is opened at one end surface side of the wear ring 52, and has a circular cross sectional shape to have a predetermined depth. As shown in FIGS. 2 and 5, the magnets 70 are inserted into the magnet holes 72, and for example, fixed using adhesive, etc.

Since the magnets 70 are thinner than the wear ring 52, in the state where the magnets 70 are placed in the magnet holes 72, the magnets 70 are provided in the wear ring 52 without protruding from the end surface of the wear ring 52.

Further, as shown in FIG. 2, in the state where the wear ring 52 containing the magnets 70 is placed in the cylinder tube 12, the sensor attachment rail 24 is provided at a position adjacent to a corner of the cylinder tube 12 facing the magnets 70, i.e., a corner of the cylinder tube 12 that is close to one of the magnets 70.

Figure 8:
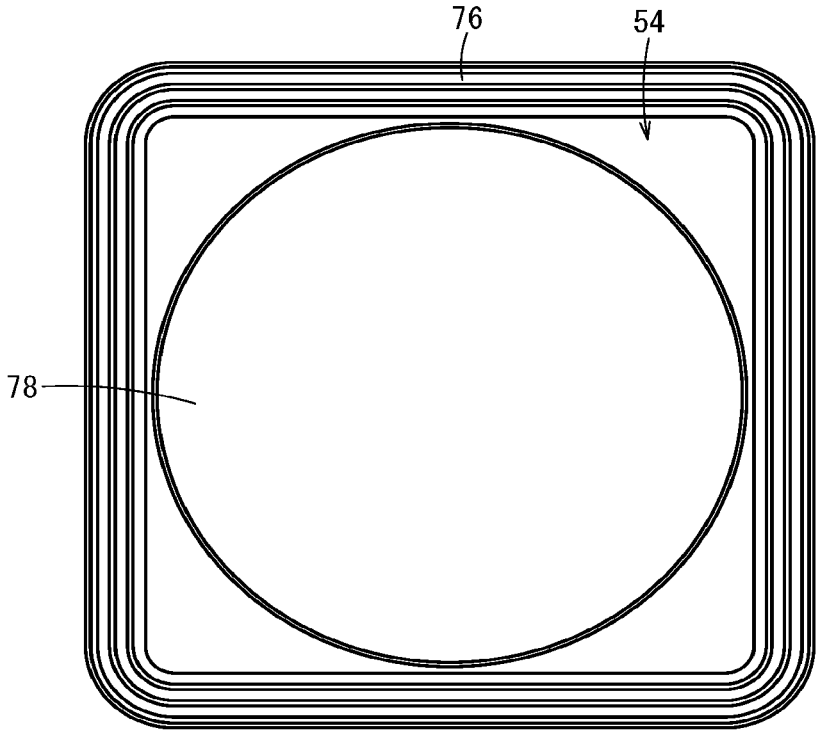
FIG. 8 is a front view of a piston packing.
Figure 9:
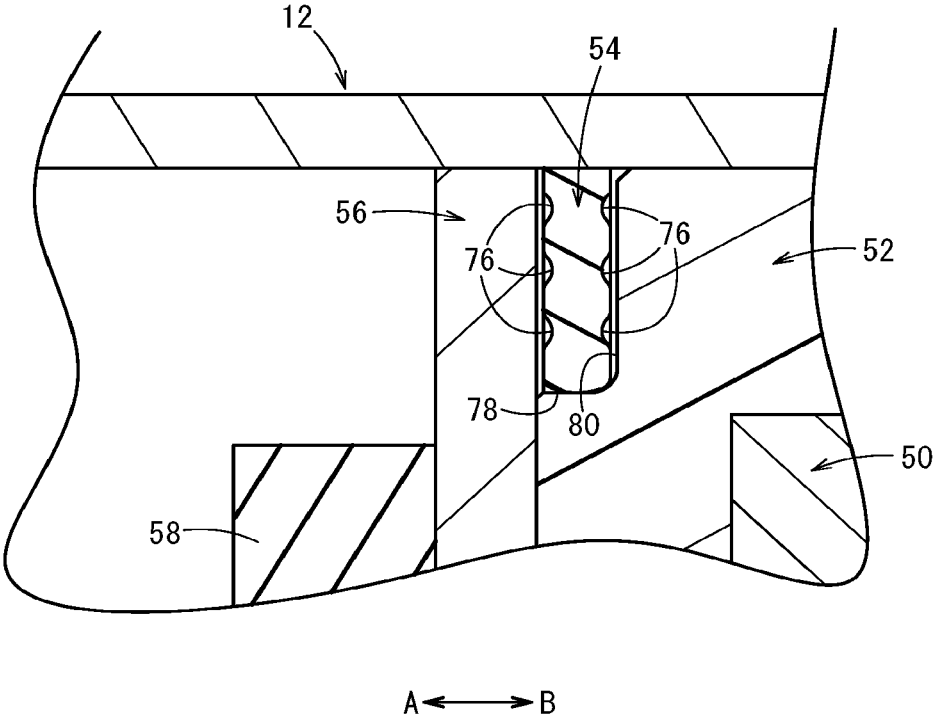
FIG. 9 is an enlarged cross sectional view of an area around an outer marginal portion of the piston packing in FIG. 3.

As shown in FIGS. 3, 8, and 9, the piston packing 54 is made of elastic material such as rubber, and has a rectangular shape in cross section. Annular lubricant retention grooves 76 are formed adjacent to outer marginal portions at one end and the other end of the piston packing 54. The lubricant retention grooves 76 are formed at one surface of the piston packing 54 closer to the wear ring 52 (in the direction indicate by the arrow B) and the other end surface of the piston packing 54 closer to the plate body 56 (in the direction indicated by the arrow A). The lubricant retention grooves 76 are depressed to have a predetermined depth in the thickness directions (indicated by the arrows A and B) of the piston packing 54 in parallel at predetermined intervals. The number of the lubricant detection grooves 76 is, e.g., three.

Further, lubricant such as grease is retained in the lubricant retention grooves 76, and when the piston unit 18 moves in the axial direction (indicated by arrows A and B) along the cylinder tube 12, the lubricant is supplied to the inner wall surface of the cylinder tube 12 for lubrication between the piston unit 18 and the cylinder tube 12.

A packing hole 78 is opened at the center of the piston packing 54. The piston packing 54 is inserted into a recess 80 formed on the other end surface of the wear ring 52 through the packing hole 78. Thus, the piston packing 54 is attached to the wear ring 52 in a manner that the other end surface of the piston packing 54 and the other end surface of the wear ring 52 forms substantially the same plane surface (see FIG. 3).

The plate body 56 is made of metal material, and is a thin plate having a substantially rectangular shape in cross section. An insertion hole 82 is opened at the center of the plate body 56. The second projection 64 of the base body 50 is inserted into the insertion hole 82.

Figure 6:
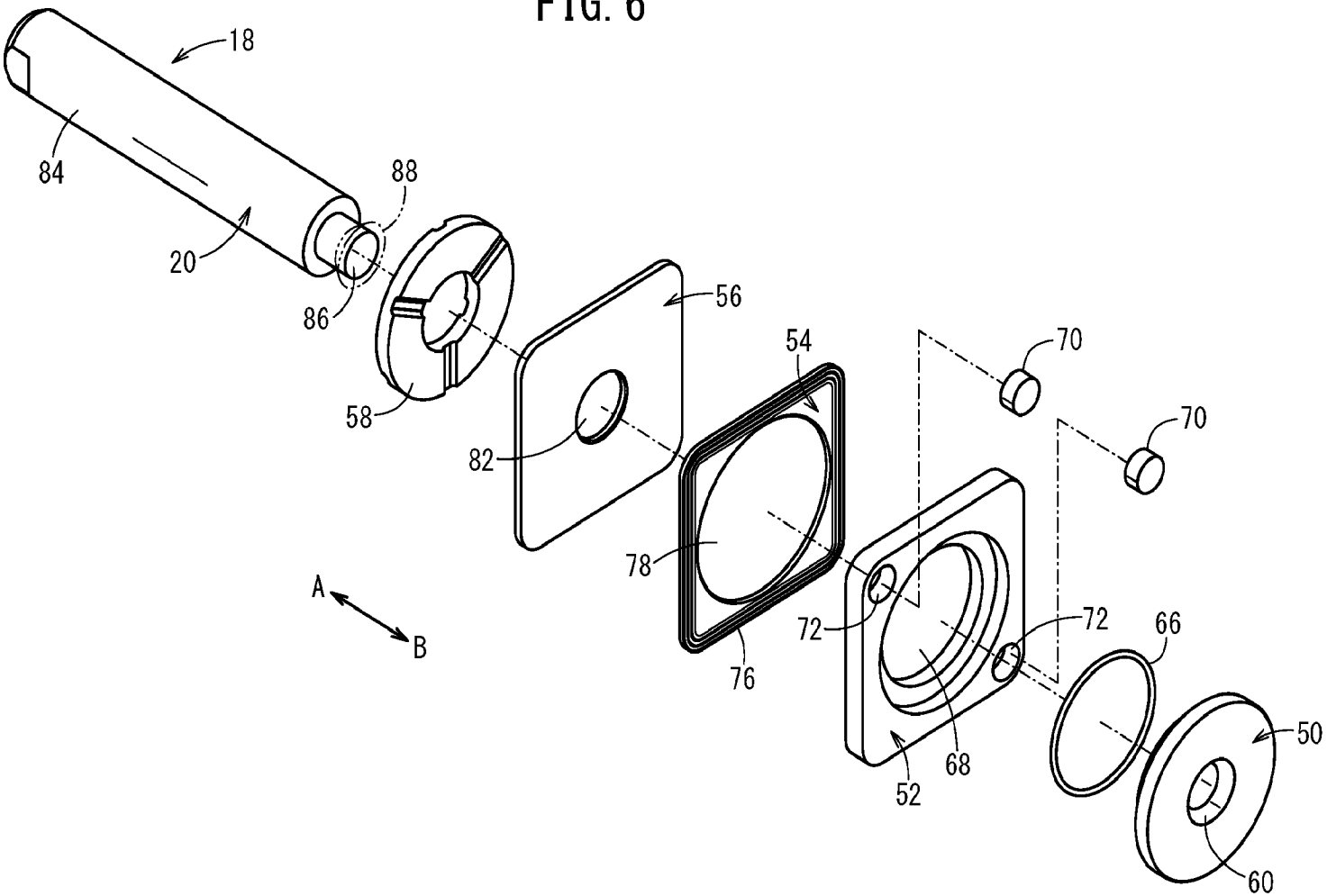
FIG. 6 is an exploded perspective view of piston unit shown in FIG. 5.
Figure 7:
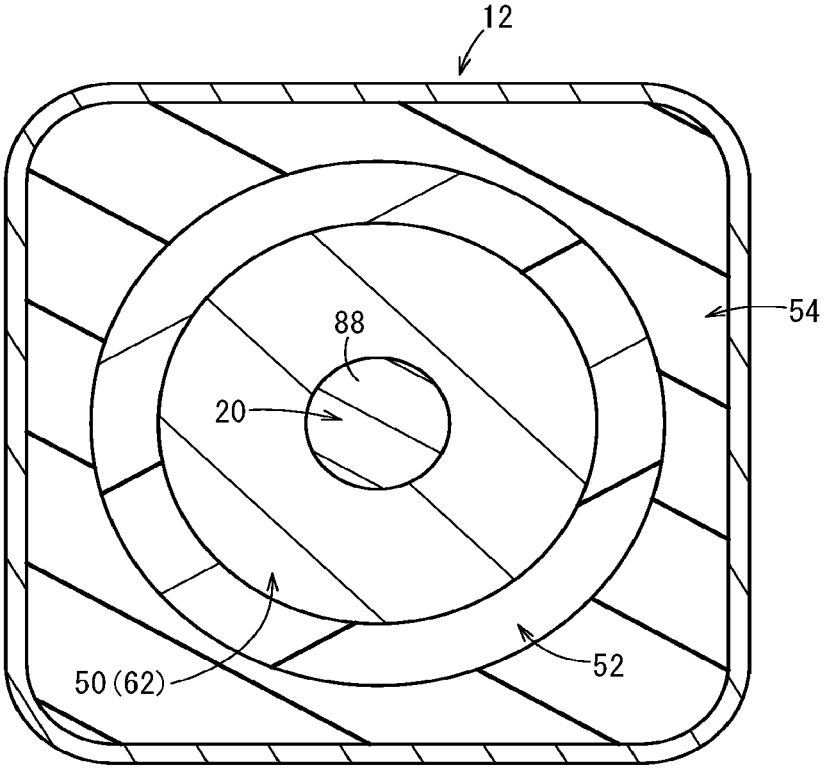
FIG. 7 is a cross sectional view taken along a line VII-VII in FIG. 1.

As show in FIGS. 1, 5, and 6, the piston rod 20 comprises a shaft body having a predetermined length in the axial direction (indicated by the arrows A and B). The piston rod 20 includes a body portion 84 formed to have a substantially constant diameter, and a small diameter front end portion 86 formed at one end of the body portion 84. A border between the front end portion 86 and the body portion 84 are formed stepwise, and the piston unit 18 is supported by the front end portion 86.

Further, as shown in FIG. 1, the other end of the piston rod 20 is inserted into the rod hole 36 of the rod cover 16, and the piston rod 20 is supported by the bush 40 provided in the rod hole 36 in a displaceable manner in the axial direction (indicated by the arrows A and B).

The base body 50 is inserted into the attachment hole 68 from one end surface side of the wear ring 52, and the plate body 56 is brought into contact with the other end surface of the wear ring 52 to which the piston packing 54 has been attached. In this state, the piston rod 20 is inserted from the plate body 56 into the swaging hole 60 of the base body 50. In the state where the plate body 56 contacts an end of the body portion 84 of the plate body 56, the front end portion 86 is crushed by a swaging jig, etc. to increase its diameter. Thus, a coupling portion 88 having the increased diameter is engaged with the swaging hole 60.

As a result, as shown in FIG. 5, the piston unit 18 is held between the coupling portion 88 (front end portion 86) and the body portion 84 of the piston rod 20. In this regard, in the space between the coupling portion 88 and the body portion 84, small clearance is formed among the base body 50, the wear ring 52, and the plate body 56 in the axial direction (indicated by the arrows A and B). Therefore, the wear ring 52, the piston packing 54, and the plate body 56 are rotatably held around the piston rod 20.

Further, in the case of limiting rotation of the wear ring 52 and the plate body 56 relative to the piston rod 20, for example, the plate body 56 and the first projection 62 in the wear ring 52 are designed to have large thickness for allowing the base body 50, the wear ring 52, and the plate body 56 to contact together tightly without any clearance among these components. Thus, rotation of the wear ring 52 and the plate body 56 relative to the piston rod 20 is limited, and the piston rod 20 and the piston unit 18 can be fixed together integrally. That is, this structure is suitable in the case where rotation of the piston rod 20 relative to the piston unit 18 is not preferable.

The fluid pressure cylinder 10 according to the first embodiment of the present invention basically has the above structure. Next, operation and working effects of the fluid pressure cylinder 10 will be described below. In the following description, a state where the piston unit 18 is displaced toward the head cover 14 (in the direction indicated by the arrow B) will be referred to as the initial position (FIG. 1).

Firstly, the pressurized fluid is supplied into the first fluid port 30 from a pressurized fluid supply source (not shown). In this case, the second fluid port 44 is opened to the atmospheric air by the switching operation of a switching valve (not shown). Thus, the pressurized fluid is supplied from the first fluid port 30 to the connection hole 26, and the piston unit 18 is pressed toward the rod cover 16 (in the direction indicated by the arrow A) by the pressurized fluid supplied from the connection hole 26 into the cylinder chamber 22. By the displacement operation of the piston unit 18, the piston rod 20 is displaced as well. When the second damper 58 contacts the rod cover 16, the piston unit 18 is stopped at the displacement end position.

In the case where the piston unit 18 is displaced in the direction (indicated by the arrow B) opposite to the above direction, the pressurized fluid is supplied to the second fluid port 44, and the first fluid port 30 is opened to the atmospheric air by switching operation of the switching valve (not shown). Then, the pressurized fluid is supplied from the second fluid port 44 to the cylinder chamber 22 through the connection channel 46. The piston unit 18 is pressed toward the head cover 14 (in the direction indicated by the arrow B) by the pressurized fluid supplied into the cylinder chamber 22.

Then, by displacement operation of the piston unit 18, the piston rod 20 is displaced as well. When the base body 50 of the piston unit 18 contacts the first damper 28 of the head cover 14, the piston unit 18 returns to the initial position (see FIG. 1).

As described above, in the first embodiment, the piston unit 18 of the fluid pressure cylinder 10 has a rectangular shape in cross section. The cylinder tube 12 containing the piston unit 18 has a rectangular shape in cross section corresponding to the piston unit 18. Thus, in comparison with the case of the fluid pressure cylinder equipped with a piston having a circular shape in cross section, when the diameter of the piston having a circular cross section and the length of one side of the piston unit 18 are substantially the same, it is possible to achieve the sufficient pressure receiving surface area. Consequently, it is possible to increase the thrust force in the fluid pressure cylinder 10, drive the piston unit 18 by supplying the pressurized fluid into the cylinder chamber 22 at low pressure, and save the energy by reducing the quantity of consumed pressurized fluid.

Further, the piston unit 18 includes the wear ring 52 which slides on the inner wall surface of the cylinder tube 12 for guidance in the axial direction (indicated by the arrows A and B), and the magnets 70 can be provided inside the wear ring 52. In the structure, in comparison with the case where the wear ring 52 and the magnets 70 are provided in alignment in the axial direction in the outer circumferential surface of the piston, since the size of the piston unit 18 in the axial direction is suppressed, it is possible to achieve size reduction of the fluid pressure cylinder 10.

Further, the magnets 70 are provided for the wear ring 52 having a rectangular shape in cross section which does not rotate in the cylinder tube 12. In the structure, the magnet 70 does not need to have a ring shape for the piston having a circular shape in cross section which might be rotated inside the cylinder tube 12. As a result, it is possible to reduce the size of the magnets 70, and reduce the production cost. Stated otherwise, since there is no need to use ring shaped magnets 70, it is possible to reduce the volume of the magnets 70.

Furthermore, since the magnets 70 are provided to face the corners of the cylinder tube 12, by arranging the sensor attachment rail 24 for attaching the detection sensor at a position adjacent to the corner, it is possible to reliably detect the magnetism of the magnets 70 by the detection sensor.

Further, the wear ring 52, the piston packing 54, and the plate body 56 of the piston unit 18 are rotatable relative to the piston rod 20. Thus, for example, at the time of assembling a transportation table, etc. to the other end of the piston rod 20 by screw engagement or the like, the assembling operation can be performed easily by rotating the piston rod 20. Thus, even in the case where the fluid pressure cylinder 10 is fixed to another apparatus and cannot be rotated, assembling can be performed efficiently.

Further, the wear ring 52, the piston packing 54, and the plate body 56 of the piston unit 18 are rotatable relative to the piston rod 20. Thus, even in the case where a load is applied to the piston rod 20 in a direction to rotate the piston unit 18, by only rotating the piston rod 20 relative to the wear ring 52 and the piston packing 54, it is possible to avoid application of the load to the wear ring 52 and the piston packing 54 in the rotation direction. As a result, increase in the stress by the contact between the corners and the cylinder tube 12 which may be caused when a load in the rotation direction is applied to the wear ring 52 and the piston packing 54 is prevented, and abrasion of the wear ring 52 and the piston packing 54 is suppressed. Consequently, improvement in the durability is achieved.

Further, in the above described piston unit 18, the wear ring 52, the piston packing 54, and the plate body 56 are provided rotatably with respect to the piston rod 20. However, the present invention is not limited in this respect. For example, the wear ring 52, the piston packing 54, and the plate body 56 may be fixed to contact one another in the axial direction to limit rotation of the piston rod 20 with respect to the wear ring 52, the piston packing 54, and the plate body 56. That is, depending on the application of the fluid pressure cylinder 10, it is possible to selectively use the fluid pressure cylinder 10 based on whether or not rotation of the piston rod 20 with respect the piston unit 18 is allowable.

Further, the inclination angle θ of the swage portions 12*a*, 12*b* swaged against the head cover 14 and the rod cover 16 is determined in a range of 45° to 90° (45°≤θ≤90°) toward the inner circumferential side from the axial direction (indicated by the arrows A and B) of the cylinder tube 12. Thus, it is possible to couple the cylinder tube 12 to the head cover 14 and the rod cover 16 reliably and firmly.

Figure 10:
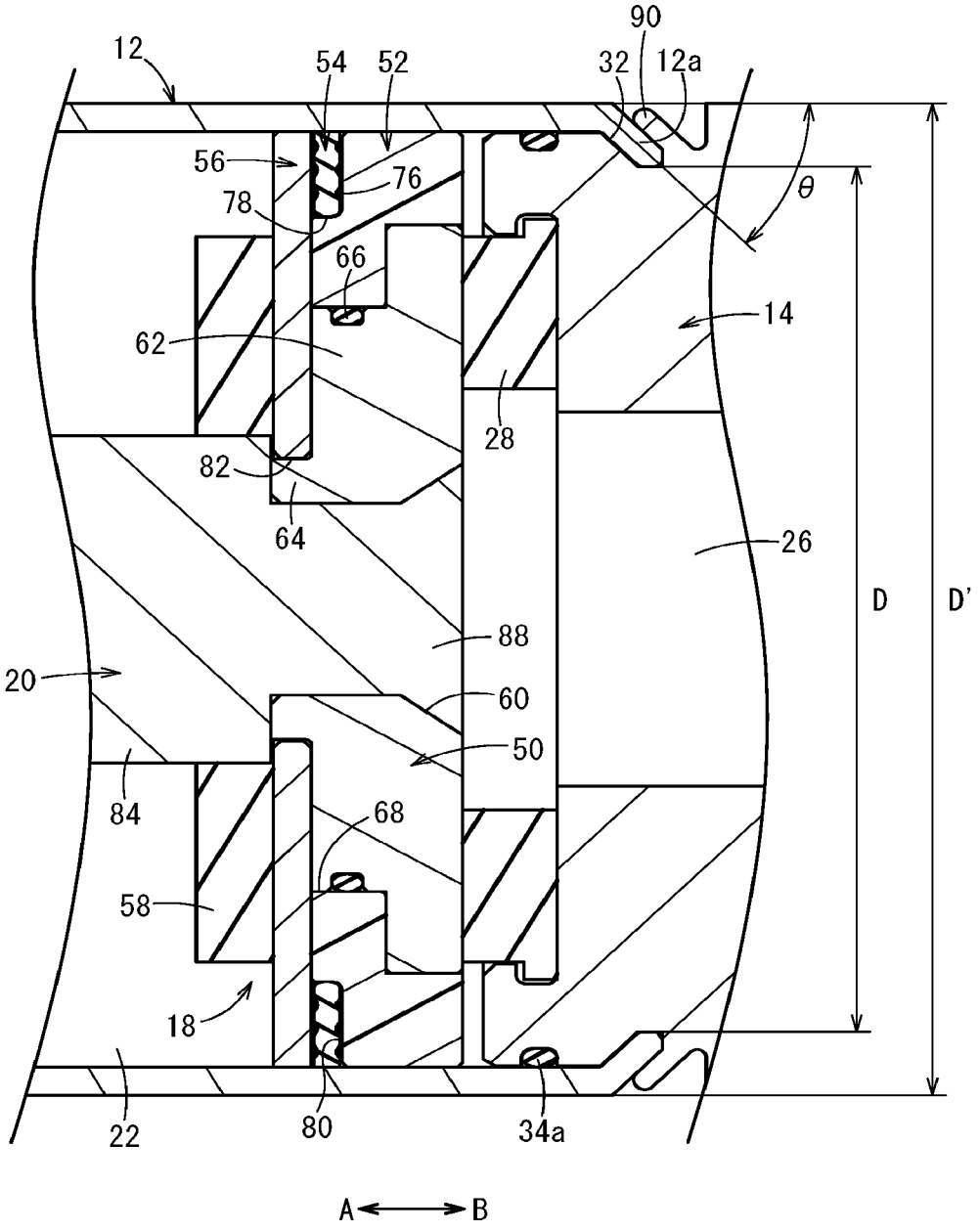
FIG. 10 is an enlarged cross sectional view of an area around a head cover, showing a modified embodiment in which a swage portion swaged by a head cover is further swaged by a cover portion.

Further, at the time of swaging the swage portion 12*a* of the cylinder tube 12 to the head cover 14, for example, as shown in FIG. 10, after the swage portion 12*a* is engaged with the first engagement groove 32, the head cover 14 adjacent to the first engagement groove 32 may be deformed by pressing the head cover 14 from the outer circumferential side by a jig, etc. (not shown) and form a cover portion 90 partially covering the swage portion 12*a* for further swaging.

In this manner, by pressing the swage portion 12*a* by the cover portion 90, the swaging strength of the swage portion 12*a* against the head cover 14 is increased. Consequently, it becomes possible to further increase the coupling strength of the cylinder tube 12 and the head cover 14.

It is not essential that this cover portion 90 is provided for the head cover 14. By forming the cover portion 90 on the rod cover 16 side, the swage portion 12*b* of the cylinder tube 12 may be swaged against the rod cover 16 reliably and firmly.

Figure 11A:
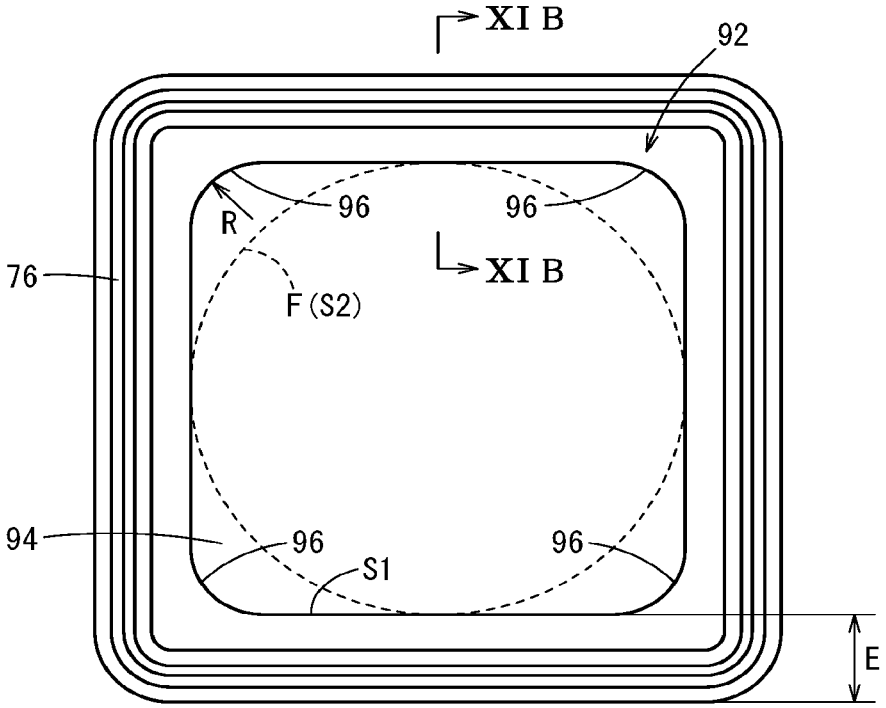
FIG. 11A is a front view of a piston packing according to a modified embodiment.

Further, as in the case of a piston packing 92 shown in FIG. 11A, a packing hole 94 formed at the center may have a rectangular shape in cross section like the outer shape of the piston packing 92. In this case, the recess 80 of the wear ring 52 is also formed in a rectangular shape in cross section. In this manner, by forming the packing hole 94 to have a rectangular shape in cross section, the width E of the piston packing 92 from the packing hole 94 to the outer marginal portion can be kept substantially constant in the circumferential direction of the piston packing 92. Therefore, it is possible to achieve the uniform surface pressure when the piston packing 92 contacts the cylinder tube 12.

As a result, uniform seal function is achieved between the piston packing 92 and the cylinder tube 12 in the circumferential direction of the piston packing 92. Specifically, ideally, the inner radius R of each corner 96 is determined to satisfy the relationship that the ratio S1/S2 is greater than 1.1, and less than 1.25 (1.1<S1/S2<1.25), where S1 denotes the circumferential length of the packing hole 94 having a rectangular shape in cross section, and S2 denotes the length of the circumference of a virtual circle F inscribed in the packing hole 94.

Figure 11B:
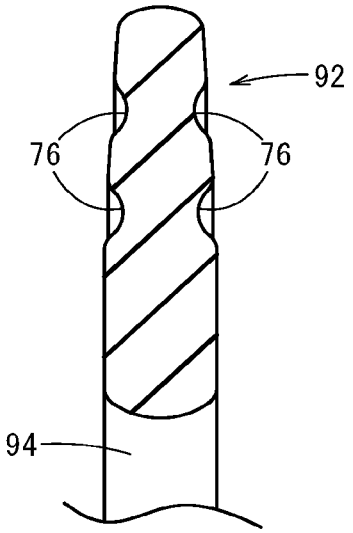
FIG. 11B is a cross sectional view taken along a line XIB-XIB in FIG. 11A.

Further, as shown in FIG. 11B, in the piston packing 92, one end surface and the other surface each having the lubricant retention grooves 76 are tapered with inclination to get closer to each other toward the outer marginal portion. Stated otherwise, the piston packing 92 gets thinner gradually toward the outer marginal portion. As described above, by reducing the thickness of the outer marginal portion of the piston packing 92, it becomes possible to achieve the uniform contact surface pressure in the contact between the piston packing 92 and the cylinder tube 12, improve the sealing performance, and reduce the sliding resistance during movement of the piston unit 18.

Next, a fluid pressure cylinder 100 according to a second embodiment will be described with reference to FIGS. 12 to 14. The constituent elements of the fluid pressure cylinder 100 that are identical to those of the fluid pressure cylinder 10 according to the above described first embodiment are labeled with the same reference numerals, and detailed description thereof is omitted.

The fluid pressure cylinder 100 according to the second embodiment is different from the fluid pressure cylinder 10 according to the first embodiment in that a head cover 102 is provided detachably at one end of the cylinder tube 12 through a stopper ring 104.

Figure 12:
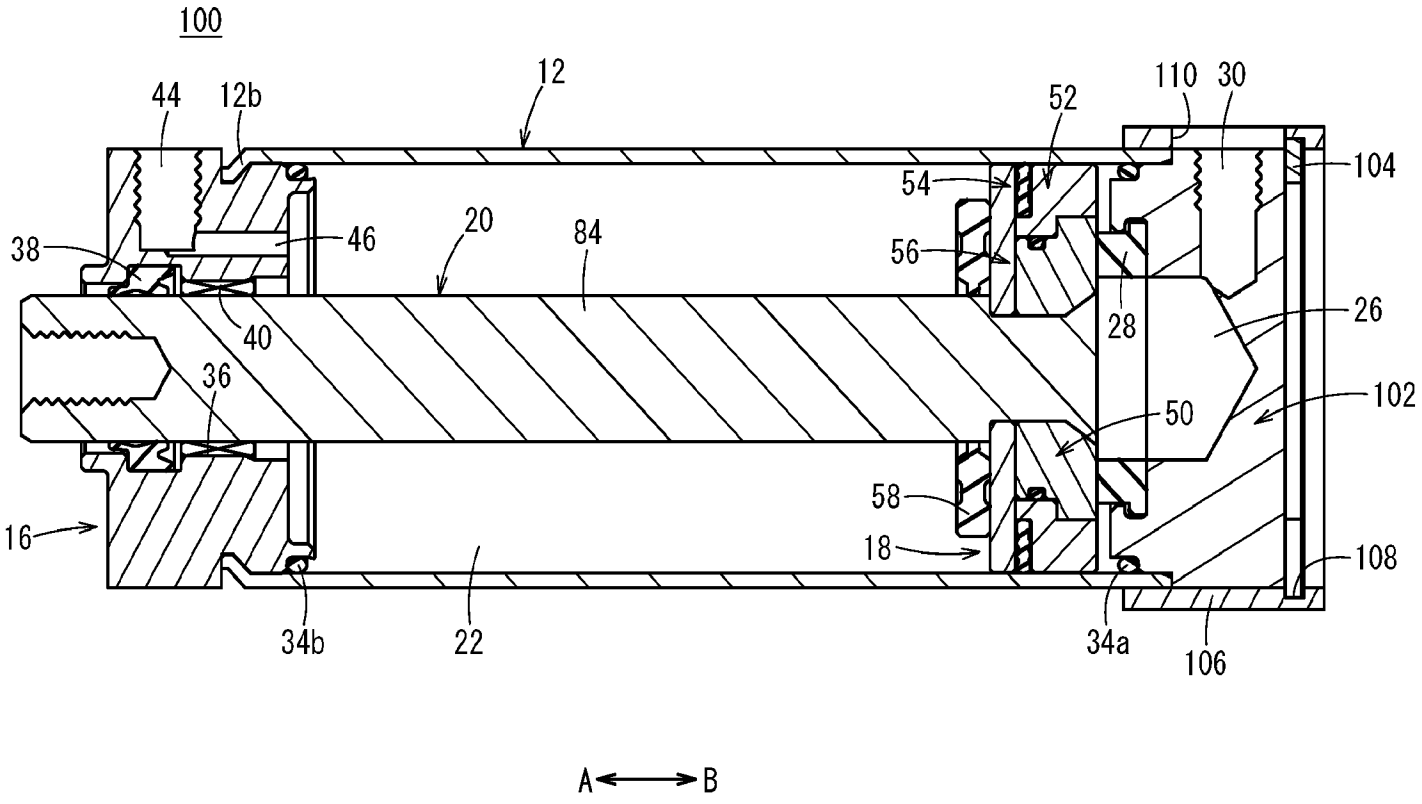
FIG. 12 is an overall cross sectional view of a fluid pressure cylinder according to a second embodiment of the present invention.
Figure 13:
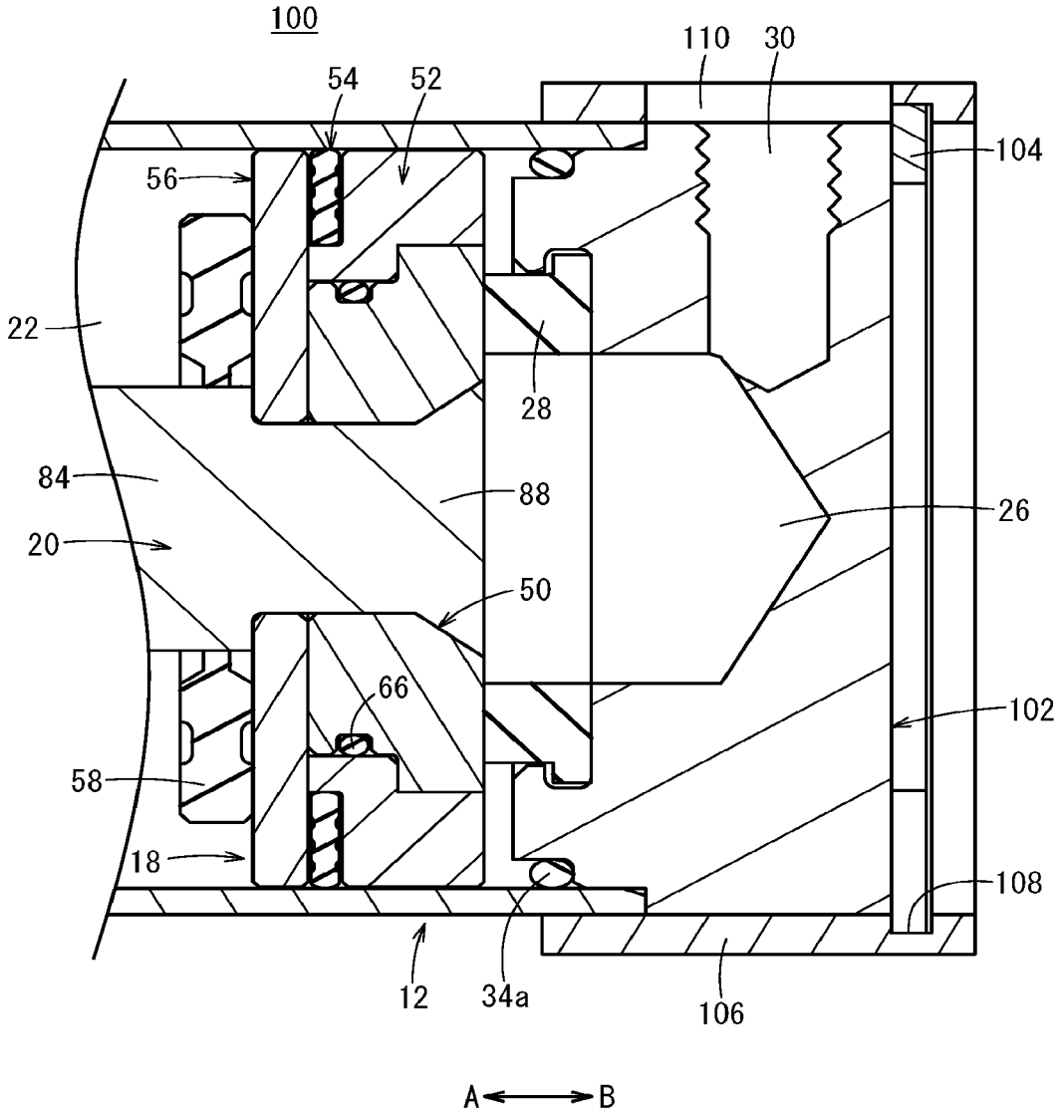
FIG. 13 is an enlarged cross sectional view showing an area around a head cover of the fluid pressure cylinder in FIG. 12.

For example, in this fluid pressure cylinder 100, as shown in FIGS. 12 and 13, a cylindrical body 106 is connected to one end of the cylinder tube 12. The diameter of the cylindrical body 106 is larger than the diameter of the cylinder tube 12. For example, the cylindrical body 106 is made of metal material such as stainless steel, and formed in a rectangular shape in cross section. The cylindrical body 106 has a predetermined width in the axial direction (indicated by the arrows A and B). Then, in the state where the inner circumferential surface at one end of the cylindrical body 106 contacts the outer circumferential surface of the cylinder tube 12, the cylindrical body 106 and the cylinder tube 12 are joined together by welding, adhesion, or the like.

That is, the cylindrical body 106 is partially overlapped with one end of the cylinder tube 12 in the axial direction (indicated by the arrows A and B), and the inside of the cylindrical body 106 is formed stepwise.

Further, an annular ring groove 108 depressed toward the outer circumferential side is formed in the inner circumferential surface of the cylindrical body 106, and the stopper ring 104 described later is engaged with the ring groove 108.

Further, a hole 110 passes through the cylindrical body 106 in the radial direction, between a connector portion connected to the cylinder tube 12 and the ring groove 108. Then, when the head cover 102 is placed inside the cylindrical body 106, the first fluid port 30 of the head cover 102 becomes coaxial with, and is connected to the hole 110 of the cylindrical body 106, and a joint or the like (not shown) is connected to the first fluid port 30 through the hole 110.

Figure 14:
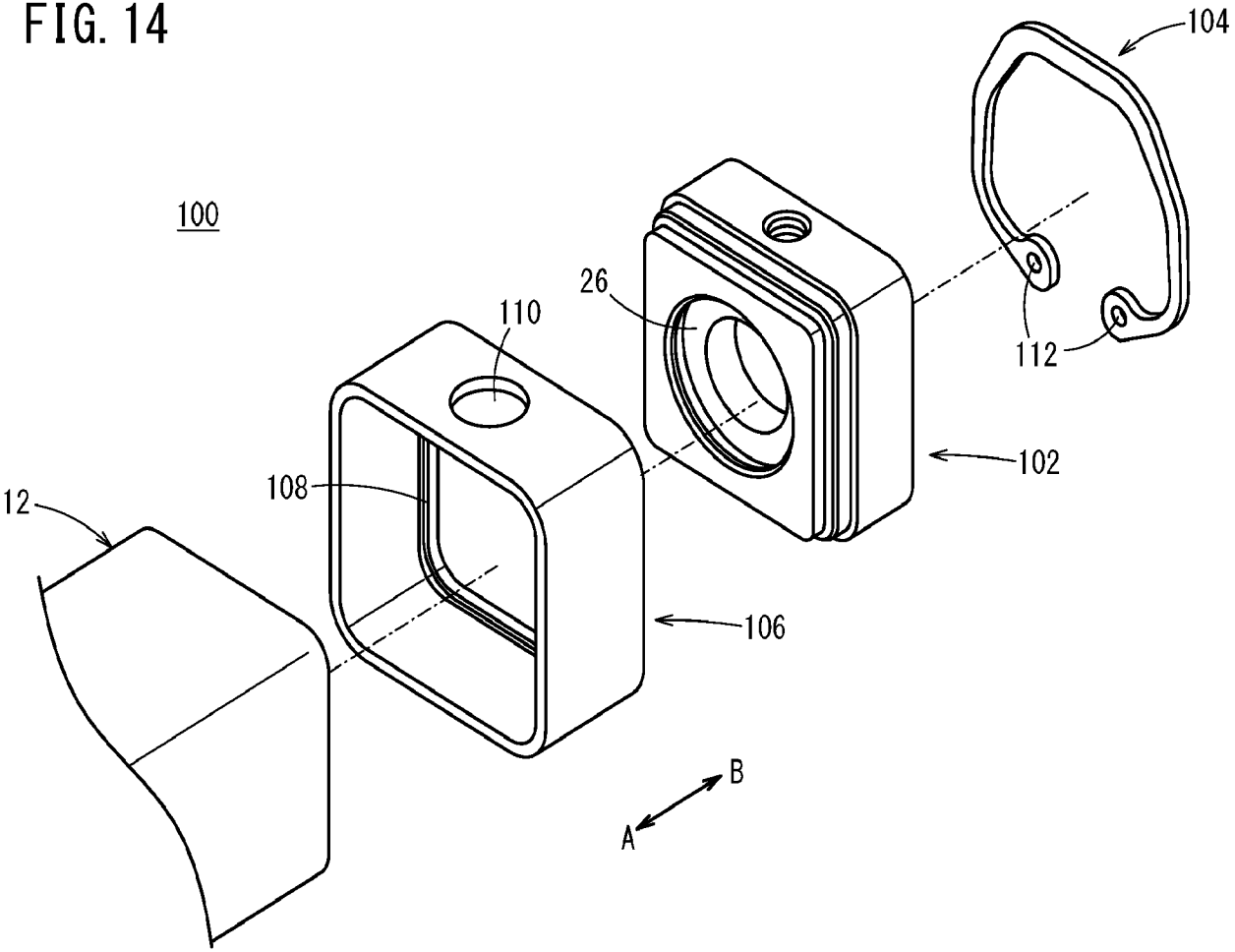
FIG. 14 is a partially exploded perspective view showing a state in which the head cover shown in FIG. 13 is detached from a cylinder tube.

As shown in FIG. 14, for example, the stopper ring 104 is made of metal material, and has a substantially octagonal shape in cross section. The stopper ring 104 is configured to apply an elastic force radially outwardly. Jig holes 112 are formed at expanding portions of the open ends of the stopper ring 104 expanding inward in the radial direction.

Then, by inserting jigs (not shown) to the pair of jig holes 112 of the stopper ring 104, and displacing the expanding portions having the jig holes 112 toward each other, the stopper ring 104 can be deformed elastically inward in the radial direction, in opposition to the elastic force.

The head cover 102 is inserted into the cylinder tube 12 and the cylindrical body 106, and contacts one end of the cylinder tube 12, and is positioned in the axial direction (indicated by the arrow A). In this state, the stopper ring 104 is engaged with the ring groove 108. In this manner, the stopper ring 104 is fixed in the state where the stopper ring 104 contacts the end surface of the head cover 102. Detachment of the head cover 102 from the opening of the cylindrical body 106 is prevented.

As described above, in the fluid pressure cylinder 100 according to the second embodiment of the present invention, the cylindrical body 106 is provided at one end of the cylinder tube 12, and in the state where the head cover 102 is placed inside the cylindrical body 106, the stopper ring 104 is engaged with, and fixed to the ring groove 108 of the cylindrical body 106. In the structure, by providing the stopper ring 104 detachably for the cylindrical body 106, it is possible to attach the head cover 102 to, or detach the head cover 102 from the cylinder tube 12 easily and reliably. As a result, in the fluid pressure cylinder 100, since the head cover 102 can be disassembled, for example, maintenance operation such as replacement of the piston packing 54 or the rod packing 38 can be performed easily.

Figure 15A:
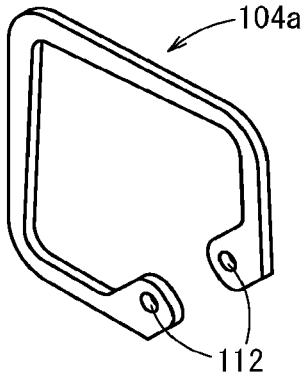
FIG. 15A is a perspective view showing an outer appearance of a stopper ring according to a first modified embodiment.
Figure 15B:
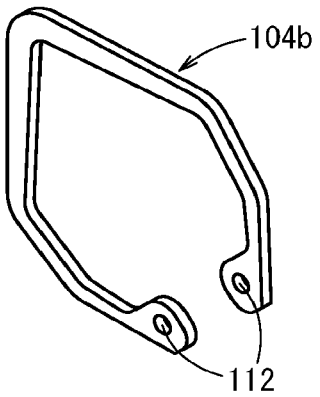
FIG. 15B is a perspective view showing an outer appearance of a stopper ring according to a second modified embodiment.

Further, the present invention is not limited to the case where the stopper ring 104 has a substantially octagonal ring shape as described above. For example, as shown in FIG. 15A, a stopper ring 104*a* having a substantially rectangular ring shape in cross section may be adopted. Alternatively, as shown in FIG. 15B, a stopper ring 104*b* having a substantially hexagonal ring shape in cross section may be adopted.

Figure 15C:
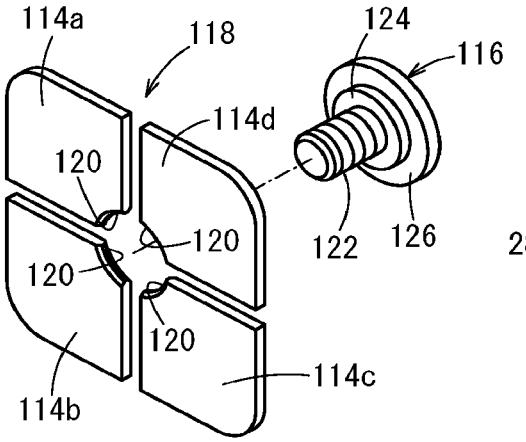
FIG. 15C is an exploded perspective view of stopper means including a plurality of plates and a tightening bolt.

Further, instead of using the stopper ring 104, stopper means 118 made up of four division plates 114*a* to 114*d* and a tightening bolt 116 shown in FIG. 15C may be used to fix the head cover 102 inside the cylindrical body 106.

The division plates 114*a* to 114*d* have substantially the same rectangular shape. Cutout portions 120 cut in a circular arc shape are formed at corners of the division plates 114*a* to 114*d*, respectively.

The tightening bolts 116 includes a threaded portion 122 where screw threads are engraved, an increased diameter portion 124 provided at an end of the threaded portion 122, and a head portion 126. The diameter of the increased diameter portion 124 is larger than the diameter of the threaded portion 122, and the diameter of the head portion 126 is larger than the increased diameter portion 124. The threaded portion 122 is screwed into a screw hole 128 formed at an end surface of the head cover 102 (see FIG. 15D).

Figure 15D:
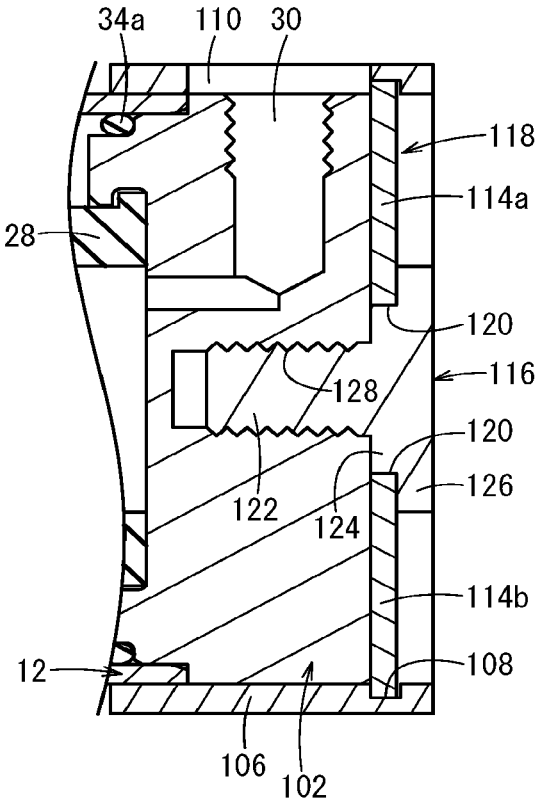
FIG. 15D is an enlarged cross sectional view showing an area around a head cover in a state where the head cover is stopped by the stopper means in FIG. 15C.

In the case of fixing the head cover 102 by the stopper means 118, as shown in FIG. 15D, in the state where the head cover 102 is placed inside the cylindrical body 106, each of the division plates 114*a* to 114*d* are brought into contact with the end surface of the head cover 102 such that the cutout portions 120 of the division plates 114*a* to 114*d* face the screw hole 128. Further, the division plates 114*a* to 114*d* are moved in directions away from the screw hole 128 along the end surface, to insert the outer marginal portions of the division plates 114*a* to 114*d* into the ring groove 108.

That is, by arranging the division plates 114*a* to 114*d*, substantially a circular hole is formed at the center by the cutout portions 120 of the division plates 114*a* to 114*d*.

Next, the threaded portion 122 of the tightening bolt 116 is screwed into the screw hole 128 through the cutout portions 120 formed in the circular shape. Consequently, the increased diameter portion 124 is brought into contact with the inner surfaces of the cutout portions 120 to limit movement of the division plates 114*a* to 114*d* toward the screw hole 128, and end surfaces of the division plates 114*a* to 114*d* are pressed by the head portion 126, and sandwiched and held between the head portion 126 and the end surface of the head cover 102.

Thus, in the state where the division plates 114*a* to 114*d* are engaged with the ring groove 108, the division plates 114*a* to 114*d* are fixed to the end surface of the head cover 102 by the tightening bolt 116. Thus, the head cover 102 is fixed inside the cylindrical body 106. Further, by rotating the tightening bolt 116 for detaching the division plates 114*a* to 114*d*, it becomes possible to unlock the fixed head cover 102 easily.

Further, though the fluid pressure cylinder 100 has been described in connection with the structure where the head cover 102 is provided detachably for the cylinder tube 12, instead of the head cover 102, the rod cover 16 may be provided detachably for the cylinder tube 12 using the stopper rings 104, 104*a*, 104*b* or the stopper means 118.

Next, a fluid pressure cylinder 150 according to a third embodiment will be described with reference to FIGS. 16 to 18. The constituent elements of the fluid pressure cylinder 150 that are identical to those of the fluid pressure cylinders 10, 100 according to the first and second embodiments are labeled with the same reference numerals, and description thereof is omitted.

The fluid pressure cylinder 150 according to the third embodiment are different from the fluid pressure cylinders 10, 100 according to the first and second embodiments in that a rod cover 152 is detachably provided at the other end of the cylinder tube 12 using a plurality of fixing bolts 154.

Figure 16:
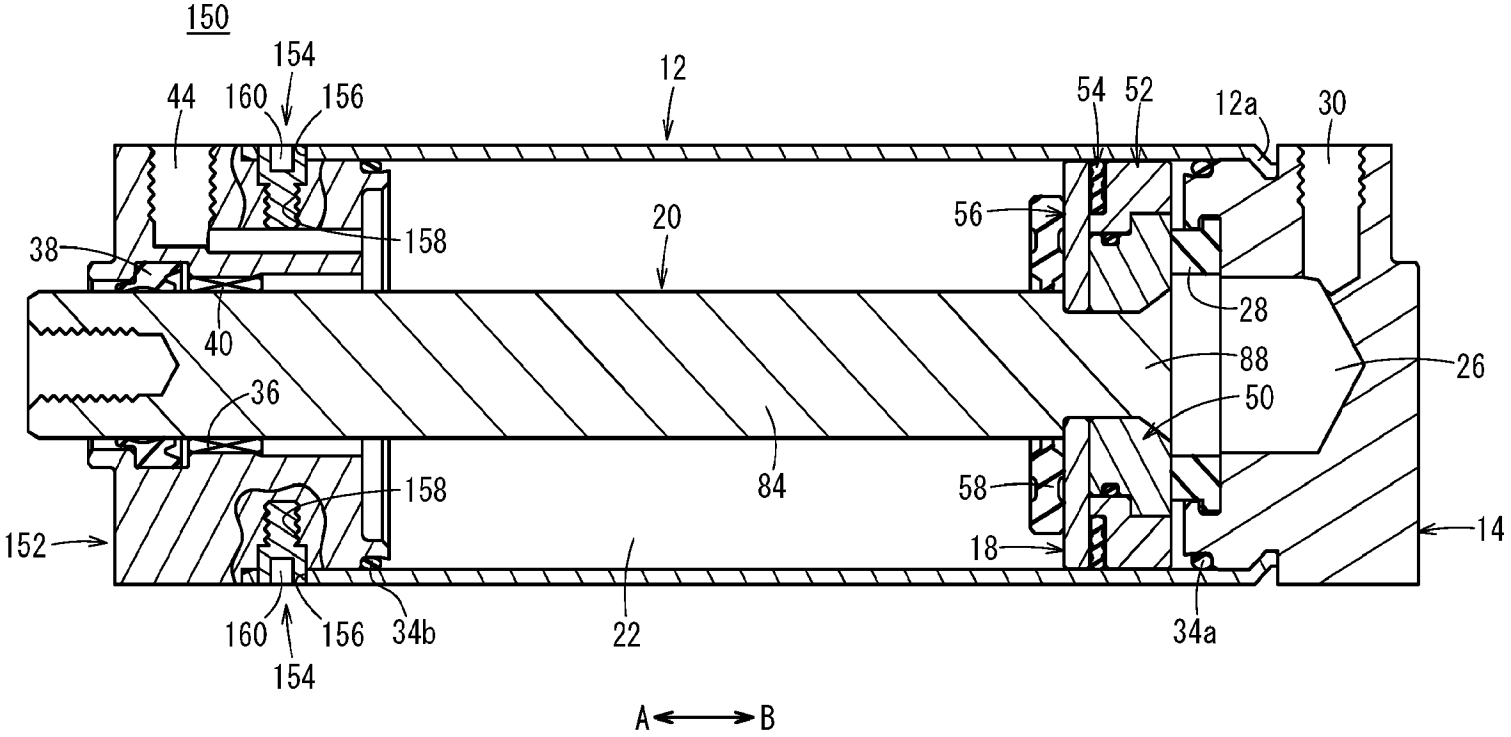
FIG. 16 is an overall cross sectional view showing a fluid pressure cylinder according to a third embodiment of the present invention.
Figure 17:
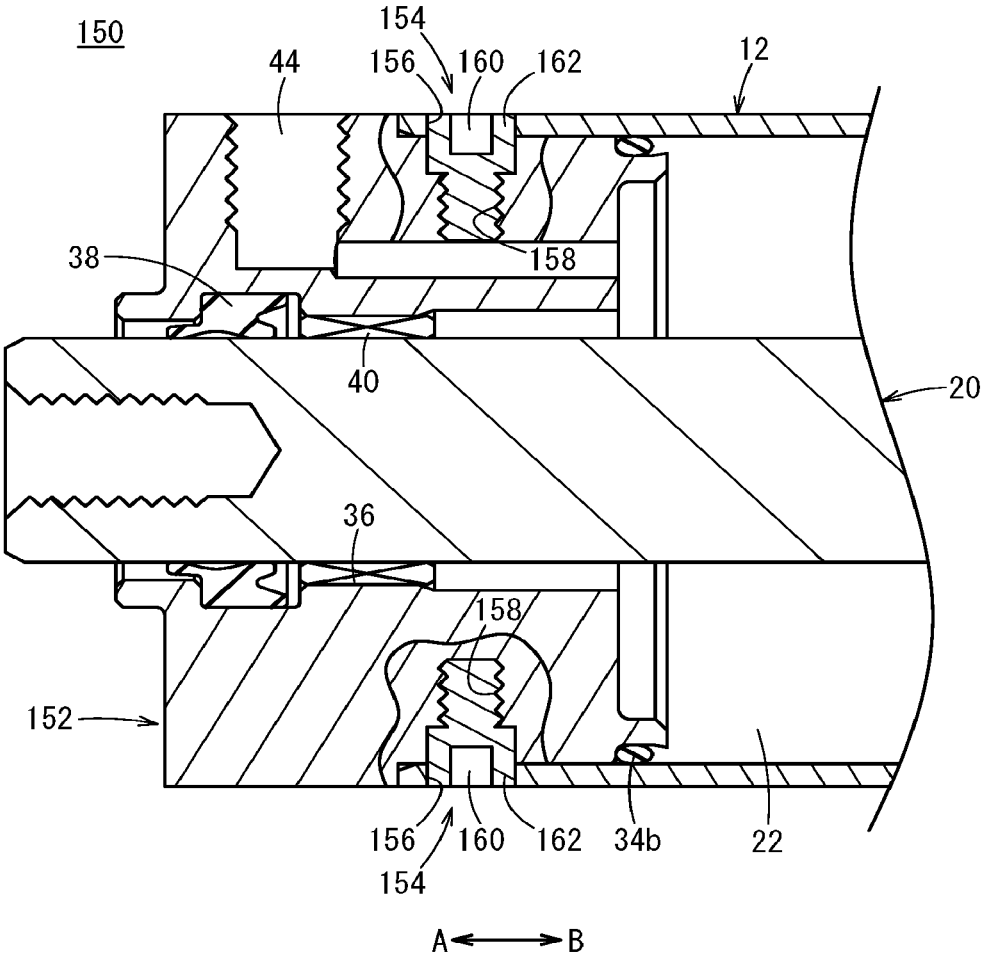
FIG. 17 is an enlarged cross sectional view showing an area around a rod cover of the fluid pressure cylinder in FIG. 16.
Figure 18:
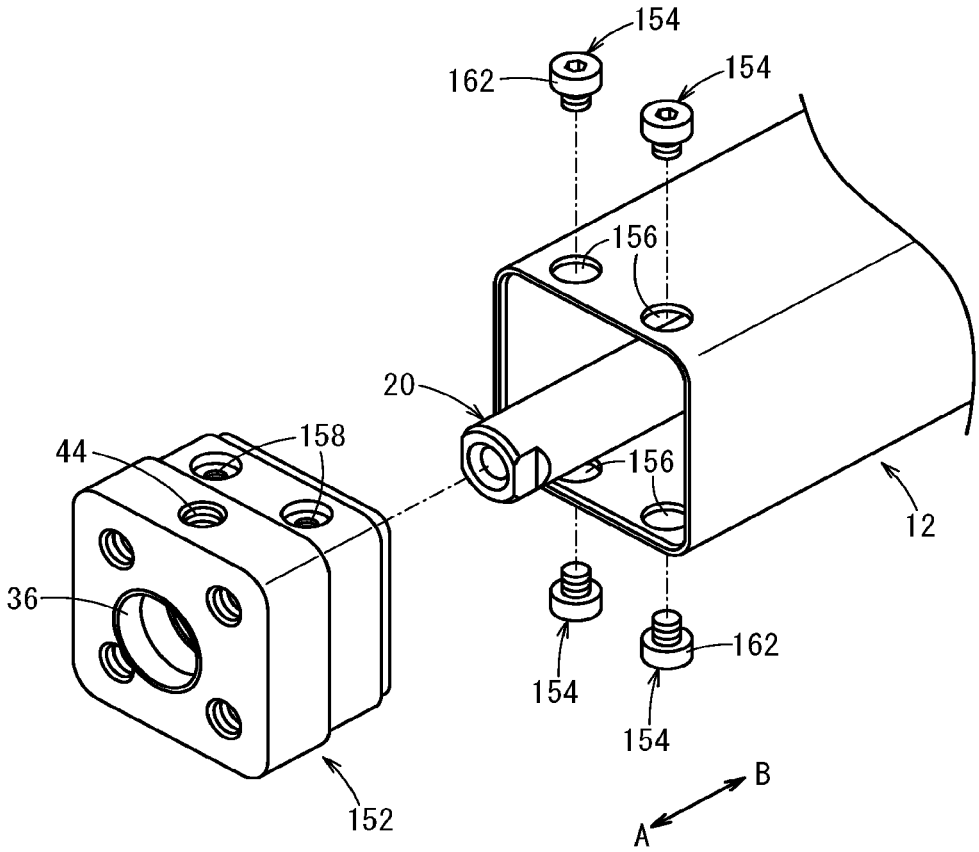
FIG. 18 is a partially exploded perspective view showing a state in which a rod cover shown in FIG. 17 is detached from a cylinder tube.

For example, in the fluid pressure cylinder 150, as shown in FIGS. 16 to 18, a pair of holes 156 are formed in an upper surface, and a pair of holes 156 are formed in a lower surface, at the other end of the cylinder tube 12, and bolt holes 158 are formed in the rod cover 152 inserted into the cylinder tube 12. The fixing bolts 154 are screwed into the bolt holes 158, and the bolt holes 158 face the holes 156.

For example, each of the fixing bolts 154 includes a head portion having a hexagonal socket (recess) 160. In the state where the rod cover 152 is placed inside the cylinder tube 12, the fixing bolts 154 are inserted, and screwed into the bolt holes 158 through the holes 156. In the structure, the fixing bolts 154 are fixed in the state in which a head portion 162 is inserted in the hole 156, and the head portions 162 each are caught in the holes 156 to limit movement of the cylinder tube 12 and the rod cover 152 in the axial direction. Thus, the cylinder tube 12 and the rod cover 152 are fixed. In this case, the fixing bolts 154 are provided in the holes 156 without protruding to the outside of the cylinder tube 12.

Further, the cylinder tube 12 may be fixed by sandwiching the cylinder tube 12 between the head portions 162 of the fixing bolts 154 and the rod cover 152.

By removing the fixing bolts 154 screwed into the side surfaces of the rod cover 152, the rod cover 152 can be removed from the cylinder tube 12 easily.

As described above, in the fluid pressure cylinder 150 according to the third embodiment of the present invention, a plurality of holes 156 are formed at the other end of the cylinder tube 12 for allowing the fixing bolts 154 to be inserted into the holes 156. The bolt holes 158 are formed in the rod cover 152 provided in the other end of the cylinder tube 12. The fixing bolts 154 inserted into the bolt holes 158 through the holes 156 are tightened to fix the other end of the cylinder tube 12 and the rod cover 152 together. In the structure, by rotating the fixing bolts 154, it is possible to attach the rod cover 152 to, and detach the rod cover 152 from the cylinder tube 12 easily and reliably. Consequently, by allowing the rod cover 152 to be disassembled in the fluid pressure cylinder 150, for example, maintenance operation such as replacement of the piston packing 54 or the rod packing 38 can be performed easily.

Further, though the above fluid pressure cylinder 150 has been described in connection with the case where the rod cover 152 is provided detachably for the cylinder tube 12, instead of the rod cover 152, the head cover 14, 102 may be provided detachably for the cylinder tube 12 using the fixing bolt 154.

The fluid pressure cylinder according to the present invention is not limited to the above described embodiments. It is a matter of course that various structures can be adopted without deviating from the gist of the present invention.

The invention claimed is:

1. A fluid pressure cylinder comprising:

a cylindrical cylinder tube including an internal cylinder chamber;

a pair of cover members attached to both ends of the cylinder tube;

a piston provided in a displaceable manner along the cylinder chamber; and a piston rod coupled to the piston, wherein each of the piston and the cylinder tube is formed to have a rectangular shape in cross section;

the piston includes a wear ring configured to slide on an inner wall surface of the cylinder tube in an axial direction of the cylinder tube;

a magnet hole in the wear ring, the magnet hole extending to an end surface of the wear ring in the axial direction of the cylinder tube; and a magnet provided in the magnet hole of the wear ring, wherein with respect to the rectangular circumference of the wear ring, the magnet is provided only in one corner of the rectangular circumference.

2. The fluid pressure cylinder according to claim 1, wherein a piston packing having a rectangular shape in cross section in a form of a sheet is provided for the piston, and the piston packing is provided adjacent to the wear ring.

3. The fluid pressure cylinder according to claim 2, wherein a lubricant retention unit that is able to retain lubricant is provided at an outer marginal portion of the piston packing, and the lubricant retention unit is in a form of a groove depressed from a peripheral surface of the piston packing in a thickness direction of the piston packing.

4. The fluid pressure cylinder according to claim 3, wherein the lubricant retention unit has an annular shape formed along the outer marginal portion.

5. The fluid pressure cylinder according to claim 3, wherein the thickness of the piston packing is decreased gradually from the center of the piston packing toward the outer marginal portion of the piston packing and the groove is depressed from the surface of the piston packing where the thickness of the piston packing is decreased.

6. The fluid pressure cylinder according to claim 2, wherein a packing hole is formed at a center of the piston packing, and the piston is configured to be attached to the packing hole; and the packing hole has a rectangular shape corresponding to an outer shape of the piston packing.

7. The fluid pressure cylinder according to claim 1, wherein a sensor attachment rail configured to attach a detection sensor for detecting magnetism of the magnet is provided at a position adjacent to a corner of the cylinder tube facing the magnet.

8. The fluid pressure cylinder according to claim 1, wherein the piston is rotatably coupled to the piston rod.

9. The fluid pressure cylinder according to claim 1, wherein the piston includes a coupling body coupled to an end of the piston rod;

the coupling body is partially placed inside the wear ring; and a seal member is provided between the coupling body and the wear ring.

10. The fluid pressure cylinder according to claim 1, wherein at least one of the cover members is provided detachably from the cylinder tube.

11. The fluid pressure cylinder according to claim 10, wherein the cylinder tube and the cover member are fixed through a tightening member.

12. The fluid pressure cylinder according to claim 10, wherein the cover member is fixed to the cylinder tube by a stopper member configured to contact an end surface of the cover member and to limit movement in an axial direction.

* * * * *